US007255250B2

(12) United States Patent
Pugne

(10) Patent No.: US 7,255,250 B2
(45) Date of Patent: Aug. 14, 2007

(54) DISPENSING CLOSURE, PACKAGE AND METHOD OF MANUFACTURE

(75) Inventor: Darin M. Pugne, Perrysburg, OH (US)

(73) Assignee: Owens-Illinois Closure Inc., Perrysburg, OH (US)

( * ) Notice: Subject to any disclaimer, the term of this patent is extended or adjusted under 35 U.S.C. 154(b) by 512 days.

(21) Appl. No.: 10/874,036

(22) Filed: Jun. 22, 2004

(65) Prior Publication Data

US 2005/0279781 A1 Dec. 22, 2005

(51) Int. Cl.
*B65D 47/00* (2006.01)

(52) U.S. Cl. ..... 222/556; 222/108; 222/213; 222/490; 222/494; 222/546; 222/547; 222/568; 215/327

(58) Field of Classification Search ..... 222/556
See application file for complete search history.

(56) References Cited

U.S. PATENT DOCUMENTS

| | | | |
|---|---|---|---|
| 4,739,906 | A | 4/1988 | LoTurco |
| 4,749,108 | A | 6/1988 | Dornsbusch et al. |
| 4,969,581 | A | 11/1990 | Seifert et al. |
| 5,141,138 | A | 8/1992 | Odet et al. |
| 5,271,531 | A | 12/1993 | Rohr et al. |
| 5,531,363 | A | 7/1996 | Gross et al. |
| 5,632,420 | A | 5/1997 | Lohrman et al. |
| 5,642,824 | A | 7/1997 | Hess, III et al. |
| 5,680,969 | A | 10/1997 | Gross |
| 5,743,443 | A | 4/1998 | Hins |
| 5,934,512 | A | 8/1999 | Lampe et al. |
| 5,934,514 | A | 8/1999 | Lampe et al. |
| 5,938,086 | A | 8/1999 | Gross |
| 5,944,234 | A | 8/1999 | Lampe et al. |
| 5,954,237 | A | 9/1999 | Lampe et al. |
| 6,006,960 | A | 12/1999 | Gross |
| 6,045,004 | A | 4/2000 | Elliott |
| 6,089,418 | A | 7/2000 | Gaiser et al. |
| 6,089,419 | A | 7/2000 | Gross |
| 6,290,108 | B1 | 9/2001 | Gross |
| 6,293,437 | B1 | 9/2001 | Socier et al. |
| 6,367,668 | B1 | 4/2002 | Schwanenberg |
| 6,371,340 | B1 | 4/2002 | Pateman et al. |
| 6,398,076 | B1 * | 6/2002 | Giblin et al. ..... 222/109 |
| 6,446,844 | B1 | 9/2002 | Gross |
| 6,494,346 | B2 | 12/2002 | Gross et al. |
| 6,530,504 | B2 | 3/2003 | Socier |

(Continued)

FOREIGN PATENT DOCUMENTS

| | | |
|---|---|---|
| BE | 892 347 | 7/1982 |

(Continued)

*Primary Examiner*—J. Casimer Jacyna

(57) ABSTRACT

A dispensing closure includes a base having a lid integrally connected to the base by a hinge. The base has a deck with a central portion, a dispensing opening in the in the central portion, and a peripheral portion surrounding the central portion. The peripheral portion includes a raised wall partially surrounding the central portion, and having a greatest height adjacent to the hinge and decreasing in height around the central portion. The wall has an inner surface that blends with the central portion of the deck to form a concave channel surrounding the central portion of the deck. The channel surface has a base that is angled with respect to the peripheral portion down and away from the raised wall.

38 Claims, 4 Drawing Sheets

U.S. PATENT DOCUMENTS

| | | | |
|---|---|---|---|
| 6,578,744 | B2 | 6/2003 | Hierzer et al. |
| 6,616,012 | B2 | 9/2003 | Dark |
| 6,616,016 | B2 | 9/2003 | Hicks et al. |
| 6,672,487 | B1 | 1/2004 | Lohrman |
| 2002/0096540 | A1 | 7/2002 | Gross et al. |
| 2003/0047572 | A1 | 3/2003 | Masuda |
| 2003/0085240 | A1 | 5/2003 | Dark |
| 2003/0094467 | A1 | 5/2003 | Dark |
| 2003/0173379 | A1 | 9/2003 | Gaiser et al. |

FOREIGN PATENT DOCUMENTS

| | | | |
|---|---|---|---|
| DE | 195 17 102 | A1 | 11/1996 |
| DE | 201 16 142 | U1 | 1/2002 |
| EP | 0495440 | A2 | 7/1992 |
| EP | 0555623 | A1 | 8/1993 |

* cited by examiner

DISPENSING CLOSURE, PACKAGE AND METHOD OF MANUFACTURE

The present invention is directed to dispensing closures for fluid products such as beverages, food condiments and body lotions, to fluid dispensing packages that include such a closure, and to methods of making such a closure.

BACKGROUND AND SUMMARY OF THE INVENTION

U.S. Pat. No. 6,672,487 discloses a fluid dispensing closure and package that include a container having a body for holding a product to be dispensed and a finish having an open mouth. A dispensing closure is mounted on the container finish. In one embodiment, the dispensing closure includes a base and a lid integrally hinged to the base. The base has a deck with a dispensing opening. A flexible dispensing valve is mounted within the dispensing opening by means of a retaining ring secured to the underside of the deck surrounding the dispensing opening.

U.S. application Ser. No. 10/208,443 discloses a dispensing closure that includes a base and a lid integrally connected to the base by at least one hinge element for pivoting the lid between a closed position overlying the base and an open position remote from the base. The base includes a deck wall, a skirt coupled to the deck wall and having an internal thread or bead for securing the closure to a container, and a dispensing opening in the deck wall. The lid includes a skirt that surrounds the deck wall in the closed position of the lid. The lid skirt has an interruption at the hinge element into which the hinge element is received in the closed position of the lid. The deck wall has an upstanding part-annular arcuate wall positioned around a peripheral portion of the deck wall adjacent to the hinge element and internally adjacent to an internal surface of the lid skirt at the hinge element to retard entry of moisture through the lid skirt interruption in the closed position of the lid.

A general object of the present invention is to provide an improved dispensing closure of the described character, an improved package embodying such a closure, and an improved method of making such a closure.

The present invention embodies a number of different aspects that may be implemented separately from or, more preferably, in combination with each other.

A dispensing closure in accordance with a first aspect of the present invention includes a base having a lid integrally connected to the base by a hinge. The base has a deck with a central portion, a dispensing opening in the central portion, and a peripheral portion surrounding the central portion. The peripheral portion includes a raised wall partially surrounding the central portion, and having a greatest height adjacent to the hinge and decreasing in height around the central portion. The wall has an inner surface that blends with the central portion of the deck to form a concave channel surrounding the central portion of the deck. The channel surface has a base that is angled with respect to the peripheral portion down and away from the raised wall. Any moisture that condenses or collects on the deck thus tends to flow around the central portion of the deck to the point diametrically spaced from the hinge. In a preferred embodiment in accordance with this aspect of the invention, the channel is arcuate in cross section adjacent to the hinge, with the arcuate cross section preferably varying in radius around the central portion of the deck.

A dispensing closure in accordance with a second aspect of the invention includes a base having a lid integrally connected to the base by a hinge. The base has a deck with a domed central portion, a dispensing opening in the domed central portion, and a flexible dispensing valve mounted to the base within the dispensing opening. A peripheral portion of the base includes a raised wall partially surrounding the domed central portion. The raised wall has a greatest height adjacent to the hinge and decreases in height around the domed central portion to zero height diametrically opposite the hinge. The wall has an inner surface that blends with the domed central portion to form a concave channel surrounding the domed central portion. The channel is arcuate in cross section adjacent to the hinge, and has a base surface that is angled with respect to the peripheral portion down and away from the raised wall. In a preferred embodiment in accordance with this aspect of the invention, an annular wall underlies the deck around the dispensing opening, and an annular channel is disposed on the undersurface of the deck interiorly adjacent to the annular wall. The valve has a peripheral ledge with a bead that is received in the channel, and a retaining ring is secured within the annular wall to capture the peripheral ledge between the ring and the undersurface of the deck. The retaining ring preferably is symmetrical around its central plane, so that the ring can be assembled to the closure base from either direction.

BRIEF DESCRIPTION OF THE DRAWINGS

The invention, together with additional objects, features, advantages and aspects thereof, will be best understood from the following description, the appended claims and the accompanying drawings, in which:

DETAILED DESCRIPTION OF PREFERRED EMBODIMENTS

The disclosures of above-noted U.S. Pat. No. 6,672,487 and application Ser. No. 10/208,443 are incorporated herein by reference for background.

Figure 1:
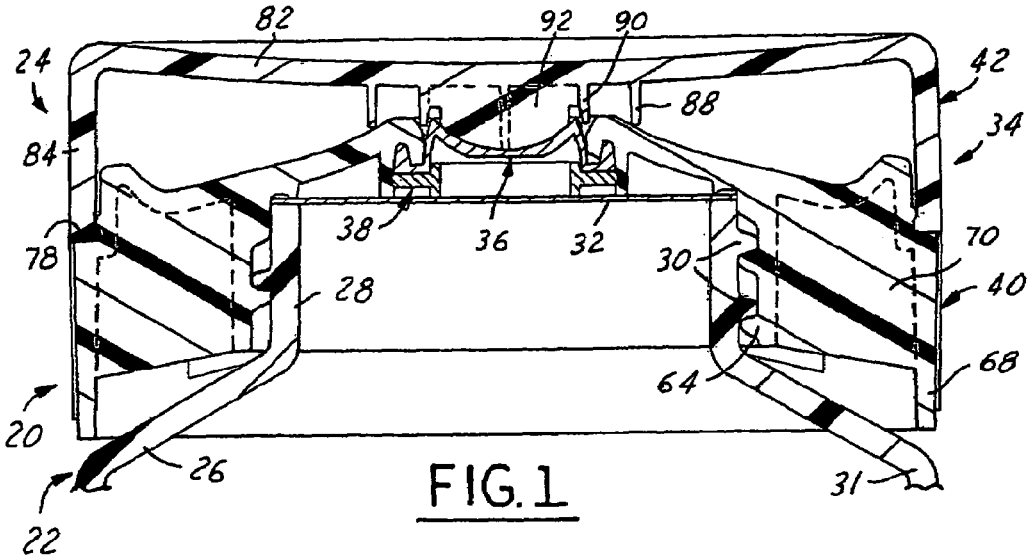
FIG. 1 is a fragmentary sectional view of a package that includes a dispensing closure in accordance with one presently preferred embodiment of the invention.

FIG. 1 illustrates a dispensing package 20 in accordance with one presently preferred embodiment of the invention as including a container 22 to which a dispensing closure 24 is secured. Container 22 has a body 26 and a cylindrical neck finish 28 with one or more external securement features, such as external threads or thread segments 30. Container 22 preferably is of molded plastic construction, having a flexible resilient sidewall 31 that may be squeezed by a user for dispensing product from within the package. A film seal 32 preferably is secured over the open end of neck finish 28 so as to close the mouth of the finish after product has been placed in the package. Film seal 32 is to be removed by a user prior to dispensing product.

Dispensing closure 24 in the illustrated preferred embodiment of the invention is a three-piece assembly that includes a shell 34 to which a flexible resilient dispensing valve 36 is secured by a retaining ring 38. Shell 34 preferably is of one-piece integrally molded plastic construction, as shown in FIGS. 4-10. Shell 34 includes a base 40 to which a lid 42 is pivotally secured by a hinge 44. Hinge 44 in the preferred embodiment of the invention comprises a pair of laterally spaced hinge elements 46, 48 that together form a snap hinge of the type illustrated in U.S. Pat. Nos. 5,794,308 and 6,041,477. However, the invention is by no means limited to snap hinges of this type, and other hinge arrangements can be employed.

Figure 5:
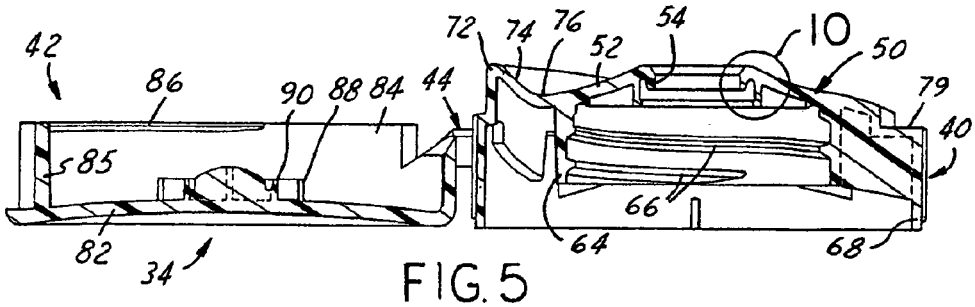
FIG. 5 is a sectional view taken substantially along the line 5-5 in FIG. 4.
Figure 6:
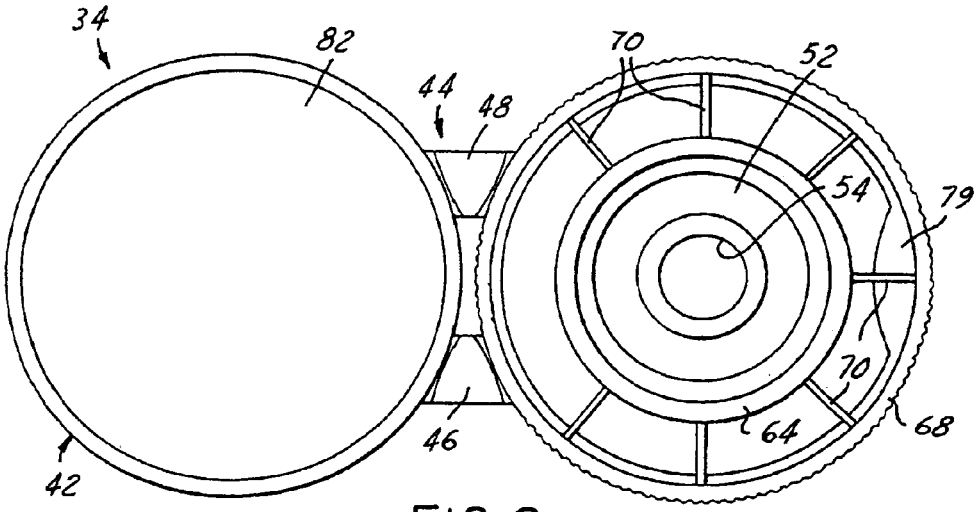
FIG. 6 is a bottom plan view of the closure shell in FIGS. 4 and 5.
Figure 10:
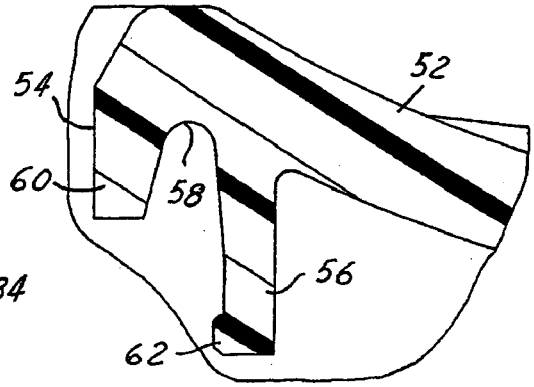
FIG. 10 is a fragmentary sectional view on an enlarged scale of the portion of FIG. 5 within the area 10.

Base 40 includes a central deck 50. The central portion 52 of deck 50 is of domed, preferably generally conical, construction. A dispensing opening 54 is positioned in deck central portion 52, preferably centrally positioned. As best seen in FIGS. 5 and 10, an annular wall 56 extends axially from an undersurface of deck central portion 52 surrounding and coaxial with dispensing opening 54. An annular channel 58 is formed on the undersurface of deck 52 between annular wall 56 and a wall 60 that surrounds dispensing opening 54. A radially inwardly extending internal bead 62 is provided on annular wall 56, and may be either circumferentially continuous or segmented. The preferred embodiment of the invention illustrated in the drawings includes an internal skirt 64 with internal attachment means, such as threads or thread segments 66, for securing the closure to a container finish, and an external skirt 68 that extends from the periphery of deck 50. External skirt 68 preferably is of a geometry to match the geometry of the associated container, such as cylindrical in the embodiment illustrated in the drawings. A circumferential array of radially and axially extending ribs 70 interconnect skirts 64, 68 for strengthening and rigidifying closure shell base 40.

Figure 7:
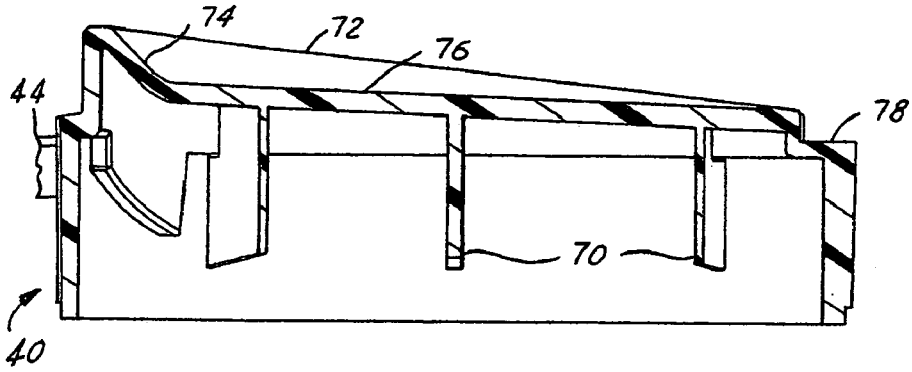
FIGS. 7, 8 and 9 are fragmentary sectional views taken substantially along the respective lines 7-7, 8-8 and 9-9 in FIG. 4.
Figure 8:
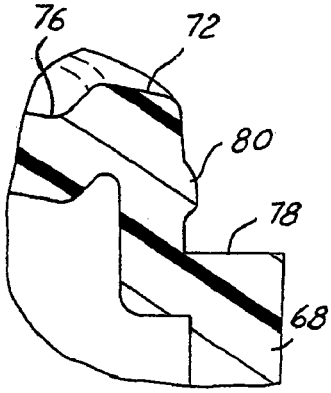
Figure 9:
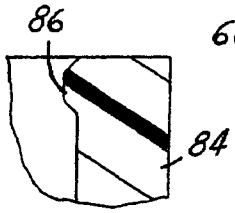

Deck 50 includes a raised wall 72 that partially surrounds the central portion 52 of the deck. Raised wall 72 has a greatest axial height adjacent to hinge 44, and decreases in height symmetrically in both directions around the periphery of central portion 52, preferably to zero height at a position diametrically spaced from hinge 44. The decreasing height of wall 72 is best seen in FIGS. 5 and 7. Wall 72 has a radially inner and surface 74 that blends with central portion 52 of deck 50 to form a concave channel 76 surrounding central portion 52. (Directional words such as "upper" and "lower" are employed by way of description and not limitation with respect to the upright orientation of the closure illustrated in FIGS. 1, 3 and 5, for example. Directional words such as "inner" and "outer" are employed by way of description and not limitation with respect to the axis of the closure or finish, as appropriate.) As best seen in FIGS. 5 and 7, channel 76 has a concave upper surface, the base or bottom of which lies in a plane that is angled with respect to the axis of the dispensing opening and with respect to the peripheral portion of deck 50. The upper surface of channel 76 has a radius of curvature that is smallest adjacent to hinge 44, and increases symmetrically around central deck portion 52 to being substantially flat diametrically opposite the hinge.

The peripheral portion of deck 50 also includes a ledge 78 that is axially recessed with respect to domed central portion 52. Ledge 78 extends entirely around central portion 52 in a plane that preferably is perpendicular to the axis of base 40. A radially outwardly extending circumferential bead 80 extends at least part way around deck 50 axially adjacent to but spaced from ledge 78. Ledge 78 is enlarged at 79 diametrically opposite hinge 44.

Figure 2:
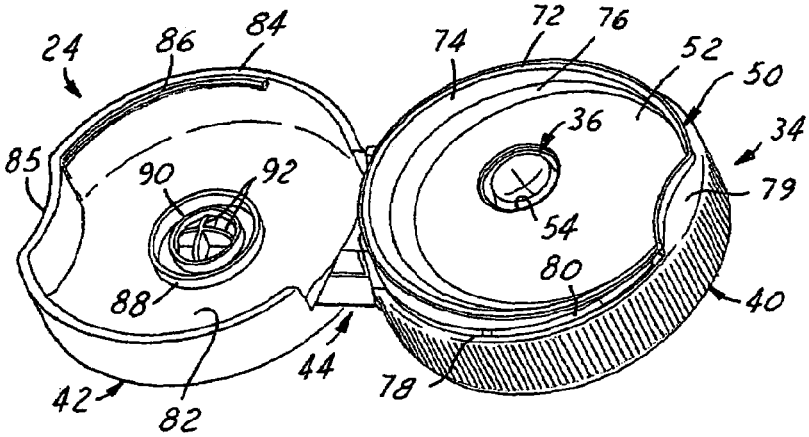
FIG. 2 is a perspective view of the dispensing closure in the package of FIG. 1.
Figure 3:
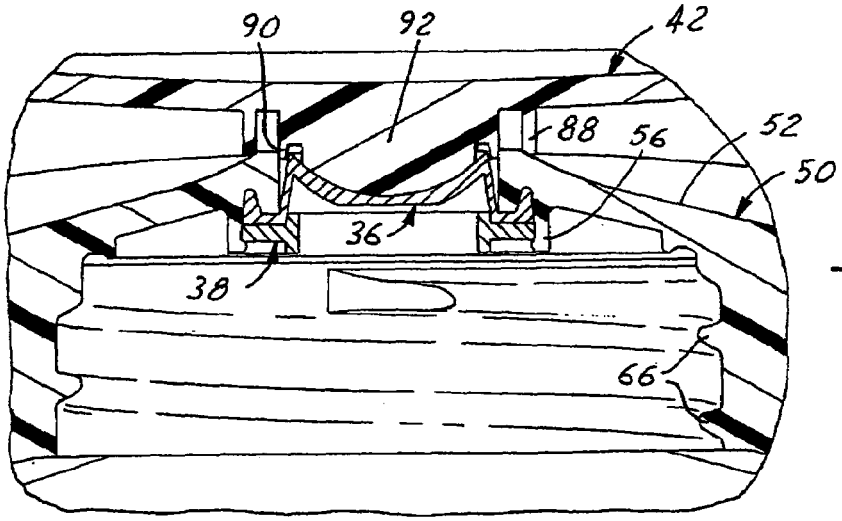
FIG. 3 is a fragmentary sectional view of the dispensing closure in FIGS. 1 and 2 with the lid closed.
Figure 4:
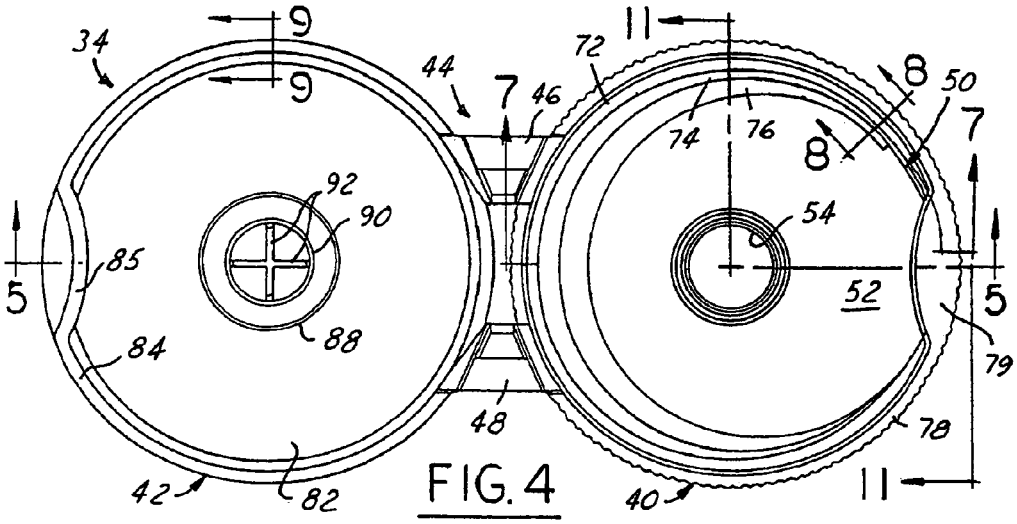
FIG. 4 is a top plan view of the dispensing closure shell in the embodiment of FIGS. 1-3.

Lid 42 includes a base wall 82 and a peripheral skirt 84. The edge of skirt 84 remote from base wall 82 preferably lies in a plane, and is adapted for edge engagement with ledge 78 on base 40 in the closed position of the lid (FIG. 1). An internal bead 86 (FIGS. 5 and 9) extends at least part way around lid skirt 84 for snap-receipt over bead 80 (FIGS. 8) to hold the lid in the closed position. An annular wall 88 on deck base wall 82 engages the upper surface of deck 50 in the closed position of the lid, as shown in FIGS. 1 and 3. An annular bead 90 on lid base wall 82, concentrically disposed within wall 88, is received between valve 36 and the inner periphery of dispensing opening 54 in the closed position of the lid, as shown in FIGS. 1 and 3. Crossed walls 92 within bead 90 are disposed adjacent to valve 36 in the closed position of the lid, as shown in FIGS. 1 and 3. Walls 92 and bead 90 help prevent valve 36 from opening when the lid is closed, thereby preventing undesired leakage of product from within the package. Skirt 84 is indented at 85 (FIGS. 2, 4 and 5), and base wall 82 extends over this indent. Ledge enlargement 79 and indent 85 form a thumb tab for opening of the closure lid.

Figure 12:
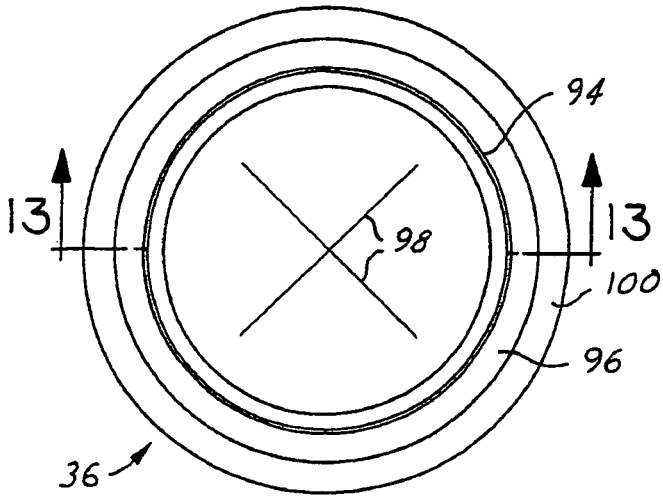
FIG. 12 is a top plan view of the dispensing valve in the dispensing closure of FIGS. 1-3.
Figure 14:
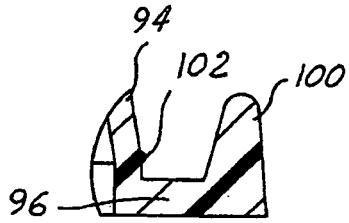
FIG. 14 is a fragmentary sectional view on an enlarged scale of the portion of FIG. 13 within the area 14.
Figure 13:
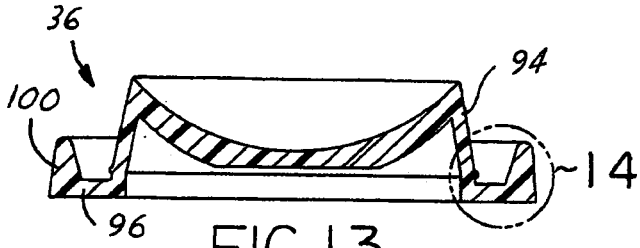
FIG. 13 is a sectional view taken substantially along the line 13-13 in FIG. 12.
Figure 15:
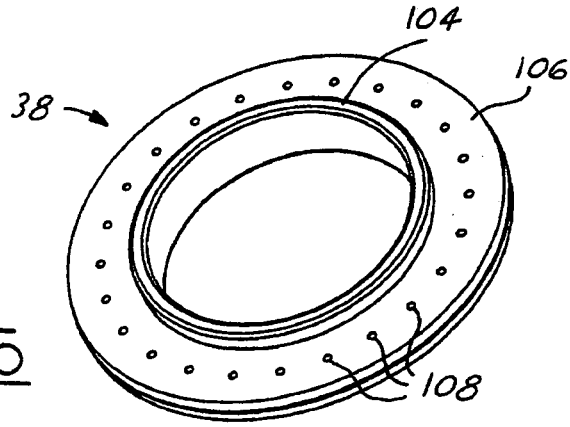
FIG. 15 is a perspective view of the valve retaining ring in the dispensing closure of FIGS. 1-3.
Figure 16:
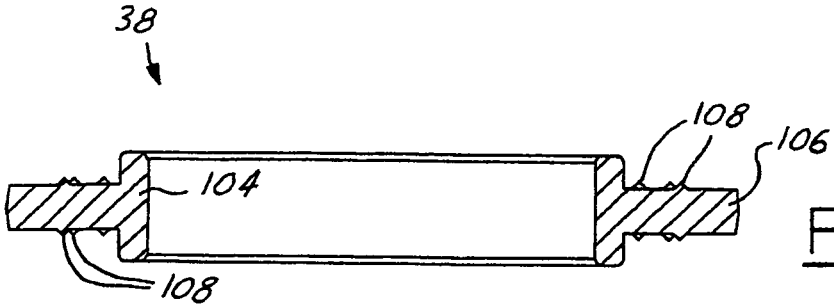
FIG. 16 is a sectional view that bisects the retaining ring of FIG. 15.

Dispensing valve 36 is shown in detail in FIGS. 12-14. Valve 36 includes a central portion 94 and an annular peripheral flange or ledge 96. Central portion 94 preferably is conical, and is angled radially inwardly from the inner periphery of ledge 96. Dispensing slits 98 are provided in central portion 94. An annular bead 100 extends around the outer periphery of ledge 96 in the same axial direction as central portion 94. A circumferential external bead 102 extends around central portion 94 adjacent to ledge 96, for purposes to be described. Retaining ring 38 is illustrated in detail in FIGS. 15 and 16. Ring 38 preferably includes a central cylindrical collar 104, from the center of which a flat flange 106 radially outwardly extends. As best seen in FIG. 16 retaining ring 38 is symmetrical on both sides of flange 106. This permits the retaining ring to be assembled to the closure from either axial direction. A circumferential array of nubs or projections 108 extend axially from the opposing faces of flange 106. Closure shell 34 and retaining ring 38 may be of any suitable material construction such as polypropylene. Dispensing valve 36 may be of any suitable flexible resilient construction such as liquid silicone rubber.

In assembly of the dispensing closure 24, valve 36 and retaining ring 38 may be assembled to shell 34 with lid 42 in either the open position or, more preferably, in the closed position. Valve 36 is placed within dispensing opening 54 of shell base 40 from beneath, with bead 100 of valve 36 disposed within channel 58 between annular wall 56 and dispensing opening wall 60. Bead 102 on valve central portion 94 frictionally engages the inner periphery of wall 60, and thereby temporarily holds valve 36 in position pending assembly of retaining ring 38. Retaining ring 38 is then snapped into position, with the outer periphery of flange 106 being snapped over and retained by bead 62 on annular wall 56. Nubs 108 on flange 106 dig into the opposing surface of valve ledge 96 and help retain the valve in position during use. Collar 104 is received within the inner periphery of valve ledge 96 as best seen in FIGS. 1 and 3, which also helps retain the valve in position. As previously noted, the symmetry of retaining ring 106 allows the retaining ring to be assembled to the closure base from either direction.

Wall 72 in the preferred embodiment of the invention not only helps to seal against entry of moisture through the hinge openings in the lid skirt (FIGS. 4 and 5), but also improves closing by increasing the height of deck 50. The additional deck height facilitates lid centering during closing and decreases the chances of moisture entering the closure. The domed deck also facilitates visual aiming when dispensing product through the closure, and facilitates cleaning of the closure top surface. Underside retention of valve 36 not only permits lid portion of the closure to be closed prior to assembly of the valve to the closure shell, but also makes valve removal more difficult. The inverted thumb tab of the preferred embodiment is well suited for some types of automatic capping equipment, and is easy for a user to open.

Figure 11:
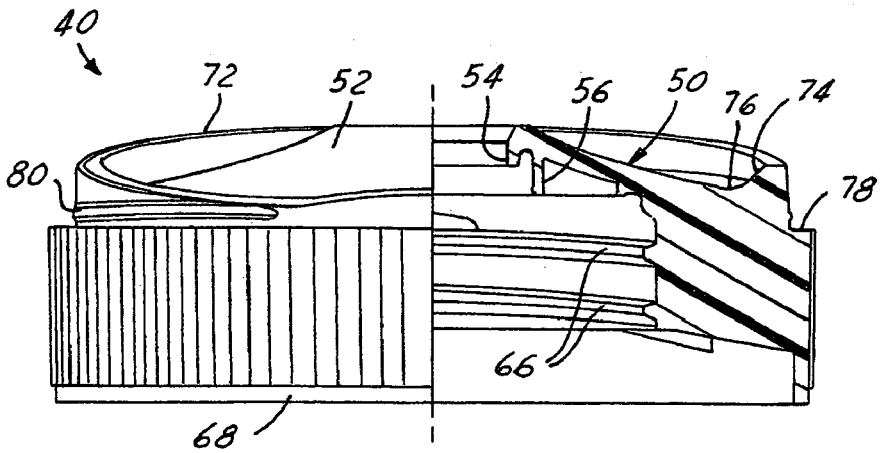
FIG. 11 is a sectional view taken substantially along the line 11-11 in FIG. 4.

There have thus been disclosed a dispensing closure, a dispensing package and a method of manufacture that fully achieve all of the objects and aims previously set forth. The invention has been disclosed in conjunction with a presently preferred embodiment, and a number of modifications and variations have been discussed. Other modifications and variations will readily suggest themselves to persons of ordinary skill in the art. For example, the dispensing closure has been disclosed in conjunction with a double-skirt base, in which the outer skirt can be circular, oval or of any desired geometry to match the geometry of the package container. However, the invention could as readily be implemented in a single skirt-type base. Wall 72 is part-circular in the disclosed embodiment, partially surrounding circular central deck portion 52. In an oval closure construction, for example, wall 72 would be part-oval partially surrounding the oval central portion of the deck. Dispensing opening 54 preferably is centrally disposed on deck 50, and preferably at a height substantially equal to the maximum height of wall 72 (FIG. 11). The dispensing opening could be off-center, and/or at a greater or lesser height than wall 72. The invention is intended to embrace all such modifications and variations that fall within the spirit and broad scope of the appended claims.

The invention claimed is:

1. A dispensing closure that includes:

a base having a lid integrally connected to said base by a hinge, said base having a deck with a central portion, a dispensing opening and a peripheral portion surrounding said central portion, said central portion of said deck being domed and having a greatest height at said dispensing opening, said peripheral portion including a raised wall partially surrounding said central portion, said raised wall having its greatest height adjacent to said hinge and decreasing in height around said central portion, said wall having an inner surface that blends with said central portion to form a concave channel surrounding said central portion, said channel surface having a base that is angled with respect to said peripheral portion down and away from said wall.

2. The dispensing closure set forth in claim 1 wherein said domed central portion of said deck is substantially conical.

3. The dispensing closure set forth in claim 1 wherein said domed central portion of said deck has a greatest height equal to said greatest height of said raised wall.

4. The dispensing closure set forth in claim 1 including interlocking beads on said lid and said base for holding said lid in a closed position over said base.

5. The dispensing closure set forth in claim 1 wherein said channel is arcuate in cross section adjacent to said hinge.

6. The dispensing closure set forth in claim 5 wherein said arcuate cross section of said channel varies in radius around said central portion.

7. The dispensing closure set forth in claim 1 wherein said base includes inner and outer skirts extending from said deck, and radial ribs integrally interconnecting said skirts.

8. The dispensing closure set forth in claim 1 including a flexible dispensing valve mounted to said base within said dispensing opening.

9. A dispensing closure that includes:

a base having a lid integrally connected by a hinge to said base, said base having a deck with a domed central portion, a dispensing opening, and a peripheral portion surrounding said domed central portion, and a flexible dispensing valve mounted to said base within said dispensing opening, said peripheral portion including a raised wall partially surrounding said central portion, said raised wall having a greatest height adjacent to said hinge and decreasing in height around said central portion to zero height diametrically opposite said hinge, said wall having an inner surface that blends with said domed central portion to form a concave channel surrounding said domed central portion, said channel being arcuate in cross section adjacent to said hinge and having a base that is angled with respect to said peripheral portion down and away from said wall.

10. The dispensing closure set forth in claim 9 wherein said arcuate cross section of said channel varies in radius around said central portion.

11. The dispensing closure set forth in claim 9 wherein said domed central portion of said deck has a greatest height equal to said greatest height of said raised wall.

12. The dispensing closure set forth in claim 9 including interlocking beads on said lid and said base for holding said lid in a closed position over said base.

13. The dispensing closure set forth in claim 9 wherein said base includes inner and outer skirts extending from said deck, and radial ribs integrally interconnecting said skirts.

14. The dispensing closure set forth in claim 9 wherein said deck has an annular wall underlying said deck around said dispensing opening and an annular channel on an undersurface of said deck interiorly adjacent to said annular wall, wherein said valve has a peripheral ledge with a bead received in said channel, and wherein a retaining ring is secured within said annular wall and captures said peripheral ledge between said ring and said undersurface of said deck.

15. The dispensing closure set forth in claim 14 wherein a central portion of said valve is angled inwardly from said dispensing opening, and wherein said lid has an annular bead that is received between said central portion of said valve and an inner periphery of said dispensing opening in a closed position of said lid over said base.

16. The dispensing closure set forth in claim 15 wherein said valve has an external bead around said central portion adjacent to said peripheral ledge for engaging and temporarily holding said valve within said dispensing opening until said retaining ring is secured to said base.

17. The dispensing closure set forth in claim 14 wherein said retaining ring includes a collar and a flange extending radially outwardly from said collar, said retaining ring being symmetrical on opposite sides of said flange.

18. The dispensing closure set forth in claim 17 including nubs on said flange for engaging said peripheral ledge of said valve.

19. A dispensing package for fluid products, which includes:

a container having a body for holding a product to be dispensed and a finish extending from said body, and a dispensing closure that includes:

a base having a lid integrally connected to said base by a hinge, said base having a deck with a central portion, a dispensing opening and a peripheral portion surrounding said central portion, said central portion of said deck being domed and having a greatest height at said dispensing opening, said peripheral portion including a raised wall partially surrounding said central portion, said raised wall having its greatest height adjacent to said hinge and decreasing in height around said central portion, said wall having an inner surface that blends with said central portion to form a concave channel surrounding said central portion, said channel surface having a base that is angled with respect to said peripheral portion down and away from said wall.

20. The dispensing package set forth in claim 19 wherein said domed central portion of said deck is substantially conical.

21. The dispensing package set forth in claim 19 wherein said domed central portion of said deck has a greatest height equal to said greatest height of said raised wall.

22. The dispensing package set forth in claim 19 including interlocking beads on said lid and said base for holding said lid in a closed position over said base.

23. The dispensing package set forth in claim 19 wherein said channel is arcuate in cross section adjacent to said hinge.

24. The dispensing package set forth in claim 23 wherein said arcuate cross section of said channel varies in radius around said central portion.

25. The dispensing package set forth in claim 19 wherein said base includes inner and outer skirts extending from said deck, and radial ribs integrally interconnecting said skirts.

26. The dispensing package set forth in claim 19 including a flexible dispensing valve mounted to said base within said dispensing opening.

27. A dispensing closure that includes:

a base having a lid integrally connected to said base by a hinge, said base having a deck with a central portion, a dispensing opening, a peripheral portion surrounding said central portion, and a flexible dispensing valve mounted to said base within said dispensing opening, said peripheral portion including a raised wall partially surrounding said central portion, said raised wall having its greatest height adjacent to said hinge and decreasing in height around said central portion, said wall having an inner surface that blends with said central portion to form a concave channel surrounding said central portion, said channel surface having a base that is angled with respect to said peripheral portion down and away from said wall.

28. The dispensing closure set forth in claim 27 wherein said deck has an annular wall underlying said deck around said dispensing opening and an annular channel on an undersurface of said deck interiorly adjacent to said annular wall, wherein said valve has a peripheral ledge with a bead received in said channel, and wherein a retaining ring is secured within said annular wall and captures said peripheral ledge between said ring and said undersurface of said deck.

29. The dispensing closure set forth in claim 28 wherein a central portion of said valve is angled inwardly from said dispensing opening, and wherein said lid has an annular bead that is received between said central portion of said valve and an inner periphery of said dispensing opening in a closed position of said lid over said base.

30. The dispensing closure set forth in claim 29 wherein said valve has an external bead around said central portion adjacent to said peripheral ledge for engaging and temporarily holding said valve within said dispensing opening until said retaining ring is secured to said base.

31. The dispensing closure set forth in claim 28 wherein said retaining ring includes a collar and a flange extending radially outwardly from said collar, said retaining ring being symmetrical on opposite sides of said flange.

32. The dispensing closure set forth in claim 31 including nubs on said flange for engaging said peripheral ledge of said valve.

33. A dispensing package for fluid products, which includes:

a container having a body for holding a product to be dispensed and a finish extending from said body, and a dispensing closure that includes:

a base having a lid integrally connected to said base by a hinge, said base having a deck with a central portion, a dispensing opening, a peripheral portion surrounding said central portion, and a flexible dispensing valve mounted to said base within said dispensing opening, said peripheral portion including a raised wall partially surrounding said central portion, said raised wall having its greatest height adjacent to said hinge and decreasing in height around said central portion, said wall having an inner surface that blends with said central portion to form a concave channel surrounding said central portion, said channel surface having a base that is angled with respect to said peripheral portion down and away from said wall.

34. The dispensing package set forth in claim 33 wherein said deck has an annular wall underlying said deck around said dispensing opening and an annular channel on an undersurface of said deck interiorly adjacent to said annular wall, wherein said valve has a peripheral ledge with a bead received in said channel, and wherein a retaining ring is secured within said annular wall and captures said peripheral ledge between said ring and said undersurface of said deck.

35. The dispensing package set forth in claim 34 wherein a central portion of said valve is angled inwardly from said dispensing opening, and wherein said lid has an annular bead that is received between said central portion of said valve and an inner periphery of said dispensing opening in a closed position of said lid over said base.

36. The dispensing package set forth in claim 35 wherein said valve has an external bead around said central portion adjacent to said peripheral ledge for engaging and temporarily holding said valve within said dispensing opening until said retaining ring is secured to said base.

37. The dispensing package set forth in claim 34 wherein said retaining ring includes a collar and a flange extending radially outwardly from said collar, said retaining ring being symmetrical on opposite sides of said flange.

38. The dispensing package set forth in claim 37 including nubs on said flange for engaging said peripheral ledge of said valve.

* * * * *